United States Patent [19]

Ciaravino

[11] Patent Number: 4,959,889

[45] Date of Patent: Oct. 2, 1990

[54] FRONTALLY "INVISIBLE" ADJUSTABLE TIE CLASP

[76] Inventor: Carlo G. Ciaravino, 1905 15th St., Boulder, Colo. 80302

[21] Appl. No.: 429,329

[22] Filed: Oct. 31, 1989

[51] Int. Cl.[5] ..... A41D 25/00

[52] U.S. Cl. ..... 24/49 R; 24/49 CF; 24/49 CP

[58] Field of Search ..... 24/49 R, 49 CF, 49 KC, 24/49 CC, 49 CP, 49 S, 49 P, 55, 57, 60

[56] References Cited

U.S. PATENT DOCUMENTS

| | | | |
|---|---|---|---|
| 1,413,131 | 4/1922 | Potter . | |
| 2,500,114 | 3/1950 | Bowder | 24/49 CP |
| 3,319,304 | 5/1967 | Adams | 24/49 R |
| 3,357,063 | 12/1967 | Eiben | 24/49 R |
| 3,494,003 | 2/1970 | Bower, Jr. | 24/49 R |
| 3,499,192 | 3/1970 | Holtz | 24/49 P |
| 3,535,748 | 10/1970 | Lely | 24/49 R |
| 3,968,544 | 7/1976 | Sinclair | 24/49 CF |
| 4,099,300 | 7/1978 | Wolak | 24/49 CF |

*Primary Examiner*—Victor N. Sakran

[57] ABSTRACT

A totally hidden tie clasp shaped like a safety pin (16) with a sliding pointed tie tack member (11) connected on the rear parallel long member (40) of the pin opposite the front long member (12), so designed so as to securely connect different, or equal, width front (F) and rear (R) pendants of any necktie, in line with each other and then by holding the holding means (26) of the sliding pointed tie tack member (11), connecting them to a wearer's shirt by piercing the rear pendant (R) with the piercing point (25) and then securing the entire tie by engaging a tie tack clutch (30) with a connecting means (35) and buttonhole engaging crossbar (37), yet allowing verticle movement of the rear pendant (R) of the tie for loosening and tightening of said necktie without showing evidence of said verticle movement on the front pendant (F) of said necktie and also allowing adjustment of the distance between the shirt of the wearer and the tie clasp.

8 Claims, 2 Drawing Sheets

FRONTALLY "INVISIBLE" ADJUSTABLE TIE CLASP

BACKGROUND-FIELD OF INVENTION

This invention relates to tie clasps and necktie holders. This invention is constructed so as to secure, in a hidden fashion, the front pendant and the rear pendant of a tie, to each other, regardless of their respective widths, and to the front of a wearer's shirt via a clutch, chain, and bar, and yet be, "invisible" from the front of the tie, not damage the front of the tie and allow adjustment, loosing and tightening of the tie without disturbing the lay of the tie when viewed from the front.

BACKGROUND DESCRIPTION OF PRIOR ART

The advantage of this mechanism over prior art, U.S. Pat. No. 3,968,544 issued to Sinclair (1976) and 4099300 issued to W. O. Bower Jr.(1970) is that the present invention is not restricted to ties where the front portion of the tie is significantly wider than the rear portion. In prior art, if the front of the tie is almost as narrow as the rear of the tie then the prior art is no longer "invisible", since it will protrude on either side of the tie. For any tie with a large rear pendant and a narrow front pendant as in a ladies scarf or a men's tie with a front pendant of equal width with the rear pendant the average prior art would not work as intended. Either the ends would stick out beyond the sides of a narrower than average front portion or the rear pendant of a wider than average tie would not fit in the average rectangular opening that should receive it. Also the intent of a tie clasp is to secure both front and rear portions of a tie so that they do not become too loose or become disengaged accidentally and then become unrestrained. The previous art, especially U.S. Pat. No. 3,968,544, could, in use, allow the rear portion of the tie to become disengaged and move about unrestrained if the rear pendant somehow slipped up through the rectangular slot, either by being too short or from excessive movements.

An argument may be taken that the tie clasp in prior art U.S. Pat. No. 3,494,003 W. O. Bower Jr. can vertically engage the rear of the front portion of the tie and the rear pendant of the tie, but the important feature of the present invention is that the rear pendant of the tie is able to move independently of the front portion thus allowing loosening or tightening of the tie without readjusting the tie clasp and without causing the front portion of the tie to bulge or buckle evidencing said movement, this is not possible with the prior art. The present invention does allow the rear portion of the tie to slide up and down in order to tighten or loosen a tie without causing a visible buckling of the fabric on the front pendant. The present invention automatically adjusts to retain a true "invisible" quality while retaining the intrinsic quality of a tie clasp of keeping the front and rear pendants of a tie in secure and consistent relation to each other and the wearer's shirt. It accomplishes this without damaging the front of the tie by piercing or clamping the front of the tie.

The connecting means, between the tie tack clutch and the buttonhole engaging crossbar, in its preferred design, would have a beaded chain so that as each bead is pulled through the buttonhole when the button is engaged, the distance of the tie assembly from the front of the wearer's shirt would shorten or lengthen. This would make the tie clasp even more desirable in that the pendants of the tie could be kept a desired distance from the front of a wearer's shirt no matter which nearby shirt buttonhole is used to receive the crossbar.

OBJECTS AND ADVANTAGES

Besides the objects and advantages of the tie clasp described in the above patent, several objects and advantages of the present invention are:

(a) to provide a tie clasp that is not noticeable when viewing the front of the tie, that is it is "invisible" to the observer.

(b) to provide a tie clasp that will allow adjustment of the rear pendant of the tie for tightening or loosening without the need for readjustment of the portion engaging the front of the tie or the rear pendant of the tie, thus retaining the "invisible" quality of the tie clasp.

(c) to provide a tie clasp that would not be limited to use on ties of usual or average widths or with rear pendants of usual or average widths, but would be useable on ties of any width or size even with identically sized front and rear pendants.

(d) to provide a tie clasp that would have all of the aforementioned advantages and also keep the tie pendants in proper relation to each other, with no chance of accidental disengagement of the rear pendant of the tie and thus to the shirt of the wearer.

(e) to provide a tie clasp that will not damage the front of the tie with a hole that could ruin the threads and leave a permanent hole that would require future use of a standard visible tie tack.

(f) because of the vertical position of the tie clasp the clasp can be left on the tie and the tie can be tied without removing the invention. It is easily passed through openings necessary in tying a tie in either a full or half knot.

(g) the connector from the tie tack would have additions along its length that would be able to be drawn through the buttonhole and would allow adjustment of the distance between the clutch and the wearer's shirt. The size and shape of these additions could vary with the only requirement being that they restrict the movement of the connector through the buttonhole.

Still further objects and advantages will become apparent from a consideration of the ensuing description and drawings.

REFERENCE NUMERALS IN DRAWINGS

10 hidden embodiment of present invention in position on a tie
11 sliding pointed tie tack member
11A sliding pointed tie tack member in an extreme position of its range of movement
11B sliding pointed tie tack member in the other extreme of its range of movement
12 front long member
13 u-shaped upper spring member
14 u-shaped lower member
15 fabric piercing point
16 front pinning means
20 latching means
25 pointed end of sliding pointed tie tack member
26 holding means
27 loop forming means on sliding tie tack member in a helical coil embodiment
30 tie tack clutch
35 connecting means
40 parallel rear long member
50 slide stopping means 50' the other slide stopping means
55 alternate embodiment of slide stopping means
60 alternate embodiment of slide stopping means
70 alternate embodiment of loop forming means.
75 alternate embodiment of loop forming means.
80 connecting means with length adjusters

SHORT DESCRIPTION OF DRAWINGS

FIG. 1 is a front view of two men's ties T and T' which are both tied with a knot at A and A' and front pendants F and F' and rear pendants R and R' both having embodiments of the present invention shown hidden by the front pendants F and F'. The first tie T shows a front pendant F significantly wider than the rear pendant R. F' shows a tie T' with a front pendant the same size as the rear pendant R'.

FIG. 2 shows the present invention removed from a tie in an open position and the sliding pointed tie tack member in several positions within its range of motion. Also shown is an embodiment of a slide stopping mechanism on either side of the sliding tie tack member as close to the ends of the rear long member of the invention as possible.

FIG. 3 is a side view of a necktie T with the front openable pointed member of the tie clasp piercing the rear layer of material of the front pendant F of a tie and emerging again through the rear layer of material of the front pendant F and engaging the latching means. The sliding pointed tie tack member is attached to the rear long member of the tie clasp between two slide stopping means on either end of the rear long member of the tie clasp. The sliding pointed tie tack member is shown piercing the rear pendant of the tie and engaging a clutch with connecting means to a crossbar that would engage the buttonhole of a shirt.

FIG. 4 a 45-degree angle view of the invention.

FIG. 5 shows the sliding pointed tie tack member before engagement on said rear long member and FIG. 5A shows said pointed tie tack member after passage of the rear long member between the coils of the helical coil and after the twisting of the sliding tie tack member 90-degrees in order to secure it around the shaft of the rear long member.

DETAILED DESCRIPTION OF DRAWINGS-FIGS. 1-10

Figure 1:
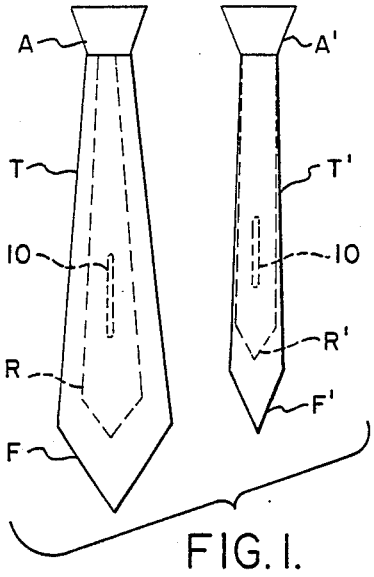

FIG. 1 shows two ties T and T', tie T has a front pendant wider that the rear pendant and the other tie T' has a front pendant the same size as the rear pendant. The invention 10 is shown hidden by the front pendant in both T and T'

Figure 2:
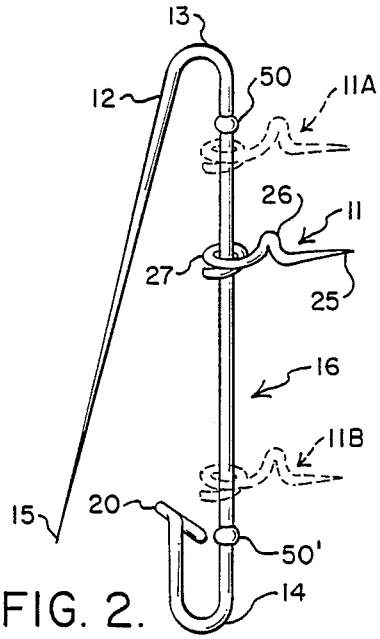

FIG. 2 shows the invention separate from the tie T as a wire shaped material formed into a front long member 12 with one end formed into a fabric piercing point 15 and an upper end as a u-shaped spring member 13 which connects to the upper end of the parallel rear long member 40. The parallel rear long member 40 is continuously connected by a lower u-shaped member 14 which curves back towards the front long member. The end of the lower u-shaped member that extends towards the front long member is formed into a latching means 20. The latching means, in this preferred embodiment, is a u-shaped bend in a plane that is turned 90-degrees to the plane of the lower u-shaped member 14 and then tilted 45-degrees from an imaginary perpendicular plane. The front long member 12 extends past the said latching means 20.

Also shown in FIG. 2 is the parallel rear long member 40 with a sphere shaped slide stopping means 50 at the point where it starts to curve into the upper u-shaped member 13 and another sphere shaped slide stopping member 50' where the other end of the parallel rear long member 40 meets the lower u-shaped member. This slide stopping means prevents the sliding tie tack member from moving past the u-shaped upper spring member or the lower u-shaped member to the front long member or into the latching means. Both the upper u-shaped member 13 and the lower u-shaped member 14 are in the same plane. FIG. 2 also shows, in a preferred embodiment, a sliding pointed tie tack member 11 that has a loop forming member 27 that encircles the rear long member 40 between the two slide stopping mechanisms 50 and 50'.

The sliding pointed tie tack member 11 also consists of a piercing point 25 engaging a clutch 30 and a holding mechanism 26. The diameter of the spherical slide stopping means is greater than the diameter of the opening of the interior of the loop forming member 27. The holding mechanism 26 of the sliding tie tack member 11 is in a preferred embodiment is formed as a flattened loop of material that is parallel and in the same plane as the parallel rear member and long enough to be grasped by the thumb and forefinger. FIG. 2 also shows the sliding tie tack member 11 in two other positions 11A and 11B showing the range of movement possible by the sliding tie tack member 11.

Figure 3:
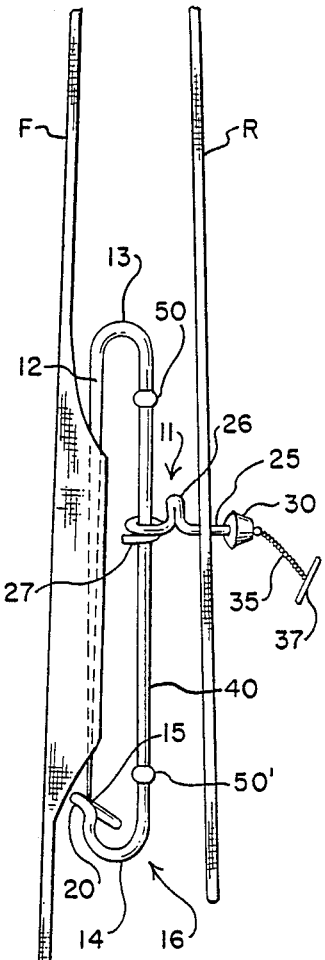

FIG. 3 is a side view of the invention connecting the front and rear pendants of a tie and engaging a standard tie tack clutch 30 which has a connecting means 35 and a buttonhole engaging means 37.

Figure 4:
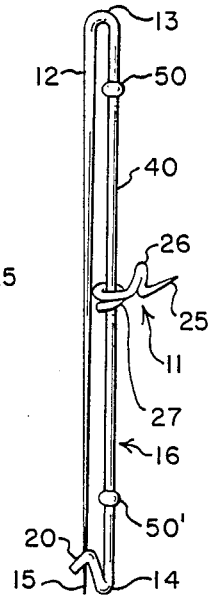
Figure 7:
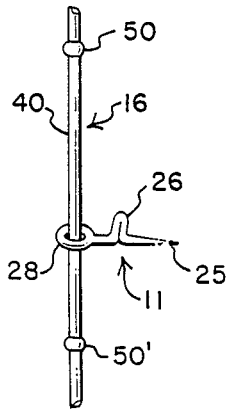
FIG. 7 depicts the sliding pointed tie tack member as having a closed loop encircling the rear long member

FIG. 4 shows a 45-degree angle view of the invention.

Figure 5:
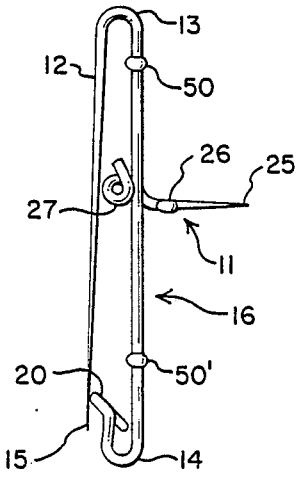
FIG. 5 and 5A show the invention in the open position.
Figure 5A:
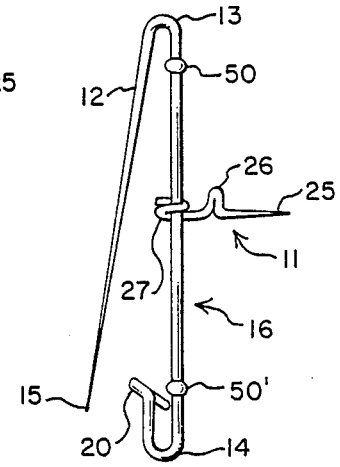

FIG. 5 shows the sliding pointed tie tack member 11 in the preferred embodiment with the loop forming member 27 prior to being connected to the parallel rear long member 40. FIG. 5A shows the loop forming member 27 after engaging the parallel rear long member 40.

Figure 6:
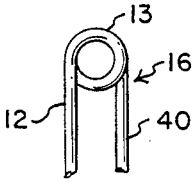
FIG. 6 shows an embodiment of the u-shaped upper spring member as a spring coil

FIG. 6 shows the u-shaped upper spring member in another embodiment where the wire shaped material forming the u-shaped upper spring member 13 is bent into a helical coil 55 to give added spring and act as a slide stopping means.

Figure 8:
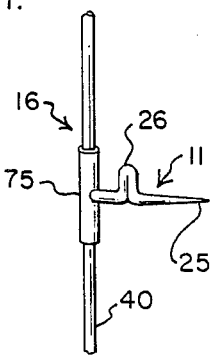
FIG. 8 depicts the sliding pointed tie tack member having a tubular shape encircling the rear long member rather than the loop or helical coil.

FIG. 8 shows an embodiment of the loop forming member 27 as a closed single loop 70 surrounding the parallel rear long member 40.

Figure 9:
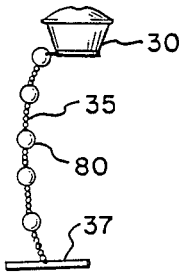
FIG. 9 shows the length adjusters on the connecting means.

FIG. 9 shows an embodiment of the loop forming member 27 of the sliding tie tack member 11 as a cylinder 75 surrounding the parallel rear long member 40 and attached to the sliding tie tack member 11 by a permanently adhesive means.

OPERATION-FIGS. 2-9

The manner of using the frontally "invisible" adjustable tie clasp is as follows: The invention is designed to hold the front pendant of a tie and the rear pendant of a tie in secure relation to each other and then to a wearers shirt. First the user pierces the rear layer of the front pendant in the verticle and horizontal center of the tie with the fabric piercing point 15. The front long member 12 is inserted its entire length vertically between the front and rear layers of the front pendant of the tie. The fabric piercing point 15 is then guided back through the rear layer of material of the front pendant on the same side and in the same verticle plane it entered and then pushed against the spring tension created by the u-shaped upper spring member in order to engage the fabric piercing point 15 in the latching means 20 by pushing the fabric piercing point 15 past the latching means 20 and then letting the spring tension push the front long member 12 outward into the u shaped section of the latching means 20, thus securing the fabric piercing point 15 against accidental release or accidental piercing of other material or the wearer.

Then the wearer holds the sliding tie tack member 11 by the holding means 26 between the thumb and forefinger and inserts the piercing point completely through the rear pendant and then into the tie tack clutch 30. The clutch is connected via a connecting means 35 to a buttonhole engaging bar 37. The sliding tie tack member 11 should be in the lower third of the distance between the upper slide stopping means 50 and the lower slide stopping means 50' and the tie should be in the tightened position prior to insertion into the rear tie pendant so as to allow maximum movement of the sliding tie tack member 11 and the rear pendant up the parallel rear long member 40 for loosening or any slight verticle movement between the front and rear pendants.

FIG. 2 shows the range of movement of the sliding tie tack member 11.

FIGS. 5 and 5A show how the preferred embodiment of the sliding tie tack member 11 is made to engage the parallel rear long member between the two slide stopping mechanisms when the sliding tie tack member is manufactured separately from the front pinning means 16. The sliding tie tack 11 is turned 90-degrees so that the parallel rear long member slips through the helical coil 27 and then is turned back 90-degrees to encircle the parallel rear long member.

FIG. 8 shows the loop forming member 27 of the sliding tie tack member 11 as a cylinder around the parallel rear long member and attached to the shaft of the sliding tie tack member 11 by means of a weld or even having a threaded end that fits into a threaded hole in the cylinder. This embodiment of the sliding tie tack member 11 would possibly eliminate the need for the upper and lower slide stopping means since the cylinder 75 could not make the turn to the front members of the tie clasp which is the purpose of the slide stopping means 50 and 50'

FIG. 9 shows the connecting means 35 with the length adjusters 80. The crossbar 37 passes through the buttonhole after the shirt is butttoned and the connecting means can be pulled through and stop at any point past a length adjuster thereby reducing the distance between the tie pendants and the wearer's shirt.

SUMMARY, RAMIFICATIONS, AND SCOPE

Thus when the frontally "invisible" adjustable tie clasp is inserted vertically through the rear layer of the tie and is secured in the latching means it remains totally hidden from the front or "invisible" from the front, and yet, allows movement of the rear pendant of the tie for loosening or tightening of the tie. Furthermore the "invisible" tie clasp has the additional advantage in that

- it can be used on any width tie, the front pendant does not have to be larger that the rear pendant. It can even be smaller.
- the frontally "invisible" adjustable tie clasp will not make a hole in the front surface of the front pendant of a tie therefore not marring the front surface of a tie.
- the rear pendant of a tie can be of any size, it does not have to fit into anything
- the frontally "invisible" adjustable tie clasp can be left on the tie even when tying the tie because it lies vertical on the tie and can fit in the spaces created when tying a tie
- the sliding tie tack member allows a good grip via the holding member for inserting the piercing point into the tie tack clutcher
- the rear pendant is securely attached to the tie clasp insuring against any accidental disengagement.
- the connecting means can have length adjusters which would allow adjustment of the distance between the tie pendants with the tie clasp and the front of the wearer's shirt.

Although the description above contains many specificities, these should not be construed as limiting the scope of the invention but merely providing some illustrations of some of the presently preferred embodiments of this invention. For example the u-shaped upper member and the slide stopping mechanism can be combined in one piece possibly made of a solid material like a plastic block. Likewise the u-shaped lower member, the lower slide stopping means and the latching means may be all one piece of material like a plastic block with secured ends of the front long member and the parallel rear long member secured in these blocks with the latching means formed in the block also. The entire tie clasp could be made of wire shaped plastic. The tie clasp can be just as easily used turned upside down.

Thus the scope of the invention should be determined by the appended claims and their legal equivalents, rather than by the examples given.

I claim:

1. A frontally, invisible, adjustable tie clasp comprising:

a. an elongated oblong shaped pinning means for securing a front pendant and rear pendant of a tie, said elongated oblong pinning means is formed of a wire shaped material comprising a front long member with the lower end having a fabric piercing point engaged in a latching means and the upper end continuously joined to a u-shaped upper spring member, the other end of said u-shaped upper spring member is continuously joined to a parallel rear long member, said parallel rear long member has, at said rear parallel member's uppermost and lowermost parallel point, a slide stopping mechanism, continuously joined at the lower end of said parallel rear member, opposite to said u-shaped upper spring member and in the same plane as the u-shaped upper spring member is a u-shaped lower member, on the end of said u-shaped lower member opposite the point where said parallel rear long member connects to said u-shaped lower member is said latching means, said latching means engages said fabric piercing point of said front long member holding said fabric piercing point securely against the spring tension of said front long member, and thus protecting said fabric piercing point from accidentally piercing the user or another fabric, said front long member is forced to angle away in an open position from the vertical when not engaged in said latching means by virtue of the spring quality of said u-shaped upper spring member thus allowing the piercing of the rear layer of material on the front pendant of a tie by said elongated oblong shaped pinning means, and b. a sliding pointed tie tack member comprising a loop forming means at one end, a piercing point at its other end and a holding means located between said loop forming member and said piercing point, said loop forming means encircles, and is there by connected to, said parallel rear member in the area on said parallel rear member between said upper slide stopping means and said lower slide stopping means, thereby said sliding tie tack member can slide up and down said rear long member without moving over to said front long member, said holding means is located between said loop forming means and said piercing point said holding means extends out vertically from either one, or both, sides of said sliding tie tack member perpendicular to the plane of the loop formed by said loop forming means whereby the user can hold said sliding pointed tie tack member by said holding means for the purpose of piercing the rear pendant of a tie and engaging a tie tack clutch, said sliding tie tack member allows movement of said rear pendant a tie independent of said front pendant of a tie and also secures said rear pendant of a tie in a verticle position behind said front pendant, said tie tack clutch is connected to a buttonhole engaging crossbar via a connecting means in order to secure said front and rear pendants of a tie with said tie clasp engaged to the front of a wearer's shirt.

2. The tie clasp of claim 1 wherein said latching means is formed of a wire shaped material into a u-shape with the unattached end of the u longer than the connected part, the u of said u-shaped latch is in a plane 90 degrees from the verticle plane of said u-shaped lower member and then tilted 45-degrees horizontally from that vertical plane.

3. The tie clasp of claim 1 wherein said loop forming means of said sliding tie tack is a loop formed as a helical coil of one and one quarter turns, said helical coil being constructed so as to allow passage of said parallel rear long member through the coils of said helical coil and then with a 90-degree twist of said sliding tie tack member resulting in said helical coil encircling said parallel rear long member at a point between both said upper and said lower slide stopping mechanism.

4. The tie clasp of claim 1 wherein said u-shaped upper spring member and said upper slide stopping member are combined in one piece of material.

5. The tie clasp of claim 1 wherein said u-shaped lower member, said lower slide stopping means, and said latching means are combined in one piece of material.

6. The tie clasp of claim 1 wherein said loop forming means is a loop formed as a cylinder that encircles said parallel rear member between said slide stopping means.

7. The tie clasp of claim wherein said u-shaped upper spring member is spring tensioned by the bending of the material into a single helical loop to add spring tension.

8. The tie clasp of claim 1 wherein said connecting means has length adjusters along the length of said connecting means.

* * * * *